US008890017B2

(12) United States Patent
Sørensen

(10) Patent No.: US 8,890,017 B2
(45) Date of Patent: Nov. 18, 2014

(54) MOTOR OPERATOR FOR SWITCHGEAR FOR MAINS POWER DISTRIBUTION SYSTEMS

(75) Inventor: Claus Hegelund Sørensen, Nordborg (DK)

(73) Assignee: Linak A/S, Nordborg (DK)

( * ) Notice: Subject to any disclaimer, the term of this patent is extended or adjusted under 35 U.S.C. 154(b) by 910 days.

(21) Appl. No.: 12/998,155

(22) PCT Filed: Sep. 24, 2009

(86) PCT No.: PCT/DK2009/000211

§ 371 (c)(1),
(2), (4) Date: Mar. 23, 2011

(87) PCT Pub. No.: WO2010/034313

PCT Pub. Date: Apr. 1, 2010

(65) Prior Publication Data

US 2011/0192707 A1 Aug. 11, 2011

(30) Foreign Application Priority Data

Sep. 24, 2008 (DK) ..... 2008 01322
Nov. 17, 2008 (DK) ..... 2008 01604

(51) Int. Cl.
*H01H 3/22* (2006.01)
*H01H 3/26* (2006.01)

(52) U.S. Cl.
CPC ..... *H01H 3/227* (2013.01); *H01H 2003/266* (2013.01)
USPC ..... 200/501; 361/615

(58) Field of Classification Search
CPC ..... H01H 3/22; H01H 3/227; H01H 3/26
USPC ..... 200/400, 501, 17 R, 605, 627, 631; 361/605, 627, 631, 632, 640, 643, 647
See application file for complete search history.

(56) References Cited

U.S. PATENT DOCUMENTS

| | | | | |
|---|---|---|---|---|
| 4,804,809 | A | 2/1989 | Thompson et al. | |
| 5,254,814 | A | 10/1993 | Harr | |
| 5,895,987 | A * | 4/1999 | Lo et al. | 361/605 |
| 8,129,644 | B2 * | 3/2012 | Christensen et al. | 200/501 |
| 8,139,345 | B2 * | 3/2012 | Christensen et al. | 361/615 |

FOREIGN PATENT DOCUMENTS

| | | | | |
|---|---|---|---|---|
| WO | WO 9716660 | A1 * | 5/1997 | H01H 3/22 |
| WO | 2006106364 | | 10/2006 | |
| WO | 2008052549 | | 5/2008 | |
| WO | 2008052550 | | 5/2008 | |
| WO | WO 2012163354 | A1 * | 12/2012 | H01H 3/58 |

* cited by examiner

*Primary Examiner* — Amy Cohen Johnson
*Assistant Examiner* — Marina Fishman
(74) *Attorney, Agent, or Firm* — Dykema Gossett PLLC

(57) ABSTRACT

A motor operator for switchgear (1) for use in mains power distribution systems such as public medium high voltage distribution systems, where the switchgear comprises a closed cabinet (2) with an operating shaft (6) accessible from the front surface (4). The operating shaft is rotatable at least between two positions and has, a coupling part. The motor operator comprises a worm gear in a separate worm gear housing (11), which is mountable on the external surface of the switchgear cabinet. An adapter (21) with a connection shaft (22) is located in a recess in the worm wheel (16). The worm of the worm gear is connected to a motor which could be located remotely from the worm gear housing and connected to the worm preferably by means of a flexible shaft (15). This renders it possible to mount the motor operator in confined spaces.

12 Claims, 6 Drawing Sheets

MOTOR OPERATOR FOR SWITCHGEAR FOR MAINS POWER DISTRIBUTION SYSTEMS

BACKGROUND OF THE INVENTION

1. Field of the Invention

The invention relates to a motor operator for opening and closing a mains switch of switchgear in mains power distribution systems such as public medium high voltage distribution systems.

2. Description of the Prior Art

Motor operators for switchgears are known see, e.g., U.S. Pat. No. 4,804,809 to Chance Co. AB, U.S. Pat. No. 5,254,814 to Chance Co. AB, WO 2008/052548 A1 to Linak A/S, and WO 2006/106364 to Viserge Ltd. These motor operators are separate units for mounting in front of switchgears as indicated in U.S. Pat. No. 4,804,809 to Chance Co. AB and WO 2006/106364 to Viserge Ltd. The motor operators are contained in a weather- and vandal-proof enclosure which is rather voluminous. Further, it should be fully operable under all weather conditions and operate in a reliable manner. The front surface of the switchgear is exposed to the open air, which is why the overall size of the motor operator is of no significant importance. However, there are also switchgears where the front surface is covered by a front door to protect the front surface of the switchgear and to prevent unauthorized access to the switchgear. The front door restricts the space available for a motor operator, and not only that, it also complicates the mounting as it is prohibited to make bores and weldings in the switchgear cabinet.

It should also be taken into account that the motor 35 operator may be activated either locally or remotely to open and close the mains switch of the switchgear. However, as a safety precaution it should also be possible to operate the switchgear manually, e.g., in case of failure of the motor operator. This also complicates the construction of the motor operator and contributes to the overall size.

Hence, there is a need for a motor operator which overcomes these and other problems associated with the known motor operators.

SUMMARY OF THE INVENTION

It is an object of the present invention to provide a motor operator which is easy to mount and could be mounted on switchgear from various manufacturers of switchgear and which to a great extent is nonintrusive and vandal proof. Another object of the invention is to provide a solution that takes up less space and thus can be mounted as a retrofit directly in the accessible part of the housing of the switchgear itself.

According to the invention this is accomplished in that the motor operator further comprises an adapter fixedly connected to the second end of the connection shaft and where a recess in the worm wheel is designed for receiving the adapter in a rotational interlocking manner. Additionally, the worm wheel and the worm is embedded in a separate worm gear housing and a driven end of the worm is accessible on the housing, preferably on a side surface for connection with the drive shaft of the motor. In this way, the overall dimension and especially the thickness of the housing can be kept very small not taking up much space in the front of the switchgear. The connection between the operating shaft of the mains switch and the motor operator is obtained by plugging the adapter into the recess of the worm wheel in a non-rotational interlocking manner, so that the adapter will be carried along in the rotational movements of the worm wheel. The worm wheel is rotated in its bearing in the worm gear housing by the worm which has a driven end to be connected to the electric motor. The electric motor could be fitted directly to the worm gear housing with the motor axle connected directly to the driven end of the worm. Since an electric motor is rather voluminous, it could be advantageous to move the motor a distance away from the worm gear housing. In some switchgear cabinets quite a lot of space is left on top of the sealed compartment of the switch, where it in a preferred embodiment would be convenient to mount the electrical motor in a separate control box also containing various electronic equipments. On the other hand, the motor and the various electronic equipments could also be located in separate housings. The connection from the motor to the driven end of the worm could be a universal transmission, such as a cardan drive. However, a flexible shaft is preferred. The flexible shaft also has the benefit that initial or peak forces to a certain degree are absorbed by the flexible shaft.

In an embodiment the recess in the worm wheel is a through hole aligned with a through hole in the worm gear housing for receiving the adapter bearing the connection shaft. The rotational interlocking of the adapter in the worm wheel so the adapter is carried along with the movements of the worm wheel could be carried out in various manners. The hole could, e.g., have a none-circular cross section, e.g., hexagonal or have at least one straight wall part. On the other hand, the hole could also be circular, but then with means for interlocking, such as retractable pins resting in holes on the other part. In a preferred embodiment the means for rotational interlocking of the adapter in the worm wheel comprises at least one key and one keyway and that the key could be pushed forward from a retracted position to an expelled position in engagement with the keyway preferable by means of a wrench for manually operation of the switchgear. In another embodiment the adapter is located in a circular recess in the worm wheel and is connected to this by a coupling such as a ball coupling.

The adapter or the entire worm gear housing has to be removed if a manual switching of the switchgear is necessary, since it will not be possible to manually drive the worm wheel with the worm and the motor, because of the mechanisms self-locking qualities. When the adapter shaft is removed, the opening in the worm wheel uncovers the operating shaft of the switchgear which can then be operated manually by inserting and using a handle tool suited for the purpose.

Conveniently, the worm gear housing will be equipped with a sensor to sense if the adapter is placed in position in the housing in relation to the worm wheel in a rotational interlocking manner. A receiver to receive the signal provides the signal to a control for monitoring the state of operation of the switchgear.

In a preferred embodiment, the motor operator includes a sensor to determine the rotation angle of the worm wheel.

The information on the rotation angle of the worm wheel can be logged together with the information on the switching transition of the mains switch contacts, and later be used to determine the position of the mains switch contacts. To use a sensor to determine the angle of the worm wheel and thus also the operating shaft of the mains switch is appreciated, since the angle for when a switching transition is accomplished varies from switchgear to switchgear, not only when it comes to different manufacturers, but also of the same type and brand. A procedure of convenience when equipping and installing a motor operator on a switchgear will be to perform a learning session, where as a first action the motor operator will force the mains switch from an open to a closed state, and accordingly store the angle on which the switching transition is activated. After that, a second action must be performed using the motor operator to force the mains switch from the closed state and back to the open state, and accordingly store the angle on which the switching transition is activated. From the stored angles it is possible to map at least three different angle scales that picture the mains switch contacts in the open state, the mains switch contacts in the closed state, and a not determined state in between the two well-defined states where the motor operator performs a switching transition of the switchgear. If the angle measurement stays in the scale where the state of the switchgear is not defined for a long period, an alarm should be issued, since it seems to indicate a failure of the motor operator. It would be appreciated if the control could maintain a log of last known stable connection to provide information regarding the state of the switchgear in case of a faulty motor operator.

In some cases there could be a need to perform a manual operation of the switchgear. It could be in the case of a faulty motor operator, or when service personnel are on site and wishes to manually operate the switchgear and perform service on the transmission line. In that case the transmission line has to be connected to the earth potential by operating the earth switch. This action can only be performed when the switchgear state is open and the handle tool for the mains switch contacts is pulled out. This means that not only the operating tool has to be pulled out, but also if the tool is substituted by the adapter inserted in the worm wheel, it also has to be pulled out. For operating the switchgear operating shaft, a spring has to be suppressed before the power of the spring is released in the transition operation of the mains switch contacts. Removing the adapter or the entire worm gear housing when the spring is not in its relaxed state will be a difficult task and would lead to a sudden release of the spring and rotation of the operating shaft, and should be avoided. To insert the adapter shaft in position back in the worm wheel will be impossible since the means for keeping the adapter shaft in a rotational interlocking manner will not be positioned to receive the adapter shaft. Anyhow, the problem can be solved by adding another two stored set points with basis in the rotation angle of the worm wheel to reflect the angle of the rotation of the worm wheel corresponding to the positions possible to insert the adapter shaft when the spring is in its relaxed state. These set points are calibrated when the motor operator is installed as part of the installation procedure of the motor operator. A procedure of convenience for the storing of the set points could be performed by first manually operating the switch gear to the open state and accordingly manually drive the motor operator until it is possible to insert the adapter and then store the angle measurement as an expression of the relaxed state of the spring when the switchgear is in its open state. As a second action unplugging the adapter and manually operating the switch gear to the closed state and accordingly manually driving the motor operator until it is possible to insert the adapter and then store the angle measurement as an expression of the relaxed state of the spring when the switch gear is in its closed state. After a manual operation, it will then be possible to automatically force the motor drive to automatically rotate the worm wheel into the angle positions where it is again possible to insert or remove the adapter. It has to be understood that the manual operations performed could be substituted with motor drive operations. Then the set points have to be made when it is possible to take out the adapter of the work wheel.

Equipping or connecting the motor operator with a sensor to detect earthing mode will be an advantage since the state of the switch gear can then be monitored from remote via the control system. For more information on a control and surveying system for a switch gear reference is made to WO 2008/052550 A1 to Linak A/S which hereby is made part of the present application. The procedures and features related to controlling the motor operator described in this document will be understood to be possible to implement and carry out in a control unit as referred to. Also the angle detection and stored set points and automated processes are understood to be carried out by the control.

In a preferred embodiment, the motor drives and the control system are arranged in a shared housing, and will benefit from being a compact and easy to install unit which is sealed and protected against the environment. An appreciated type of housing is the type of modular housing specified in WO 2008/052549 A1 Linak A/S which hereby is made part of the present application. The control system for the motor operator in form of an electronic circuitry on a printed circuit board is in an expedient way mounted in one end of the cabinet. In connection with the printed circuit board are sockets for receiving the energy to drive the motors and connections for interfacing with the control system from remote, to transfer data or to directly control the switchgear. The sockets can be placed directly on the printed circuit board and preferably arranged in a way where they fit premade holes for inserting the connectors through the walls of the cabinet. Of course this should be done in a way with respect to keeping the sealing of the cabinet intact, by adding protective means like o-rings on the connectors which go into connector ports to fit into the connection sockets. The motor drives can be placed side by side in the distant end of the cabinet, the output axles protruding out of the end of the cabinet in order to easily mount the flexible cable for connection with the driven worm on the rotary gear mechanism.

Further, the system as described is advantageous since it can be mounted retrofit, nonintrusive on a switch gear with the use of mounting brackets fitted on the outer framework of the switch gear or at already present and available mounting parts of the switchgear housing. Reference is made to WO 2008/052549 A1 Linak A/S for more information as how to mount a motor operator retrofit nonintrusive on a switch gear. Said document is hereby made a part of the present application.

An embodiment of the invention will be described in the following with reference to the accompanying drawings.

DETAILED DESCRIPTION OF THE DRAWINGS

Figure 1:
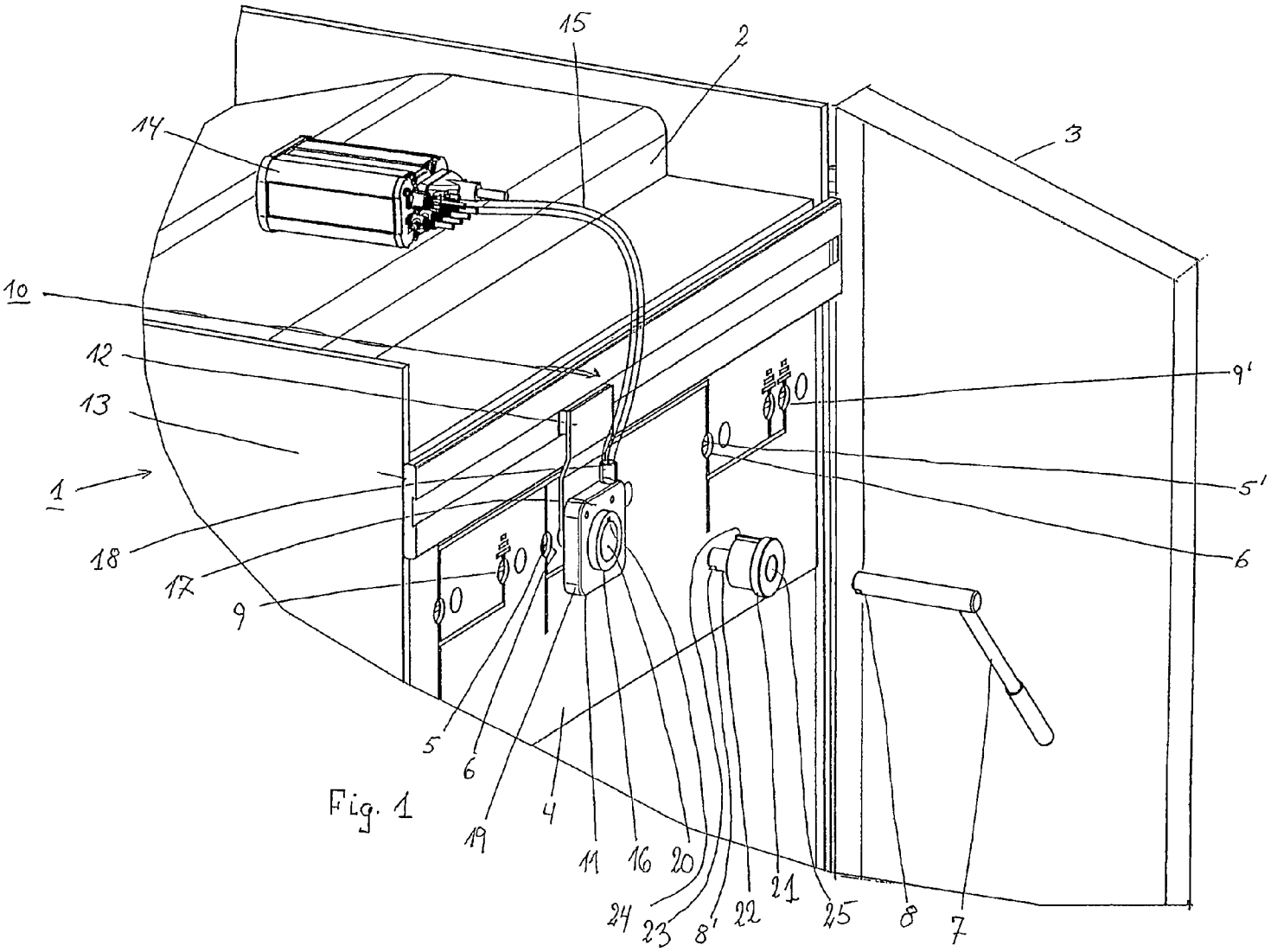
FIG. 1 shows a perspective view of a top, front part of a switchgear furnished with a motor operator.

In FIG. 1 is shown a top, front part of a switchgear 1 comprising a closed cabinet 2 inside which are located two sets of mains switches. In front of the cabinet 2 there is a hinged door 3 covering a front surface 4 of the cabinet 2. Each mains switch has an operating shaft with a coupling part 5,5' accessible through a hole 6,6' on the front surface 4 of the cabinet. The operating shaft could be operated manually by a wrench 7 having an end designed as a coupling part 8 for engagement with the coupling part 5 of the operating shaft. The coupling part 5 is the end part of the shaft having a through pin. The coupling part 8 of the wrench is tube shaped having two aligned notches in the tube wall so it could be placed over the end of the operating shaft such that the end of the through pin thereof is received in the notches in a rotational interlocking manner. When the mains switch is in an open position it is, possible to earthen the switchgear. The operating shaft for the earthing has an identical coupling as the operating shaft for the mains switch so the wrench 7 could be used for the earthing. For security reasons the earthing should always be performed manually. The operating shaft for the earthing could be reached through the hole 9,9'.

The operating shaft for the mains switch could be operated by a motor operator 10 which comprises a worm gear housing 11 mounted on a mounting bracket 12 attached to a horizontal transverse beam 13 mounted on the switchgear. Further, the motor operator comprises an electric motor 14 located remotely in a separate control box on top of the switchgear cabinet 2. A flexible connection shaft 15 interconnects the motor 14 and the worm gear housing 11.

In the worm gear housing 11 is embedded a worm wheel 16 having a collar at a front end 17 of the housing 11. Also in the worm gear housing 11 is embedded a worm, a driven end 18 of which is accessible on a sidewall 19 of the housing 11 for connection with the flexible connection 15 to the drive axle of the motor 14. The worm wheel 16 has a recess in the nature of a through hole 20 for receiving an adapter 21 with a connection shaft 22. A first end 23 of the connection shaft 22 is designed as a coupling part 8' like the coupling part 8 of the wrench 7 so it could operate the operating shaft of the mains switch. The adapter 21 has on its side a key 23 and the hole 20 of the worm wheel 16 has a mating keyway 24 so the adapter could be received in the through hole 20 of the worm wheel 16 in a rotational interlocking manner. The key 23 has a certain clearance in the keyway 24 to prevent the forces from the spring mechanism to be transferred to the worm wheel 16.

The key 23 is a separate element received in a groove in the adapter 21 and could from a retracted position be pushed out when the adapter 21 is located in the through hole 20 of the worm wheel 16 for engagement with the keyway 24 such that the adapter 21 is locked also in its lateral position to secure a correct position in the worm wheel 16 but also in relation to the coupling part 5,5' of the operation shaft of the mains switch. Most important the locking secures that the coupling part 8' of the connection shaft 15 of the adapter 21 in fact is in engagement with the operating shaft of the mains switches when the adapter 21 is correctly located in the worm wheel 16. The key 24 is resting on an eccentric in the adapter, which eccentric could be operated by means of the wrench 7 in the hole 25 at the front end of the adapter 21.

Accordingly, it would be understood that the mains switch could be operated by the motor operator when the adapter 21 has been correctly located in the worm wheel 16 and at the same time earthing is prevented. Having the need for operating the switchgear manually, the adapter 21 is removed and the wrench 7 could be inserted through the through hole in the worm wheel 16 and the rear end of the worm gear housing.

All though not shown it should be noted that a similar motor operator is mounted in connection with the other operating shaft of the switchgear the coupling part of which is indicated by 5'.

Figure 2:
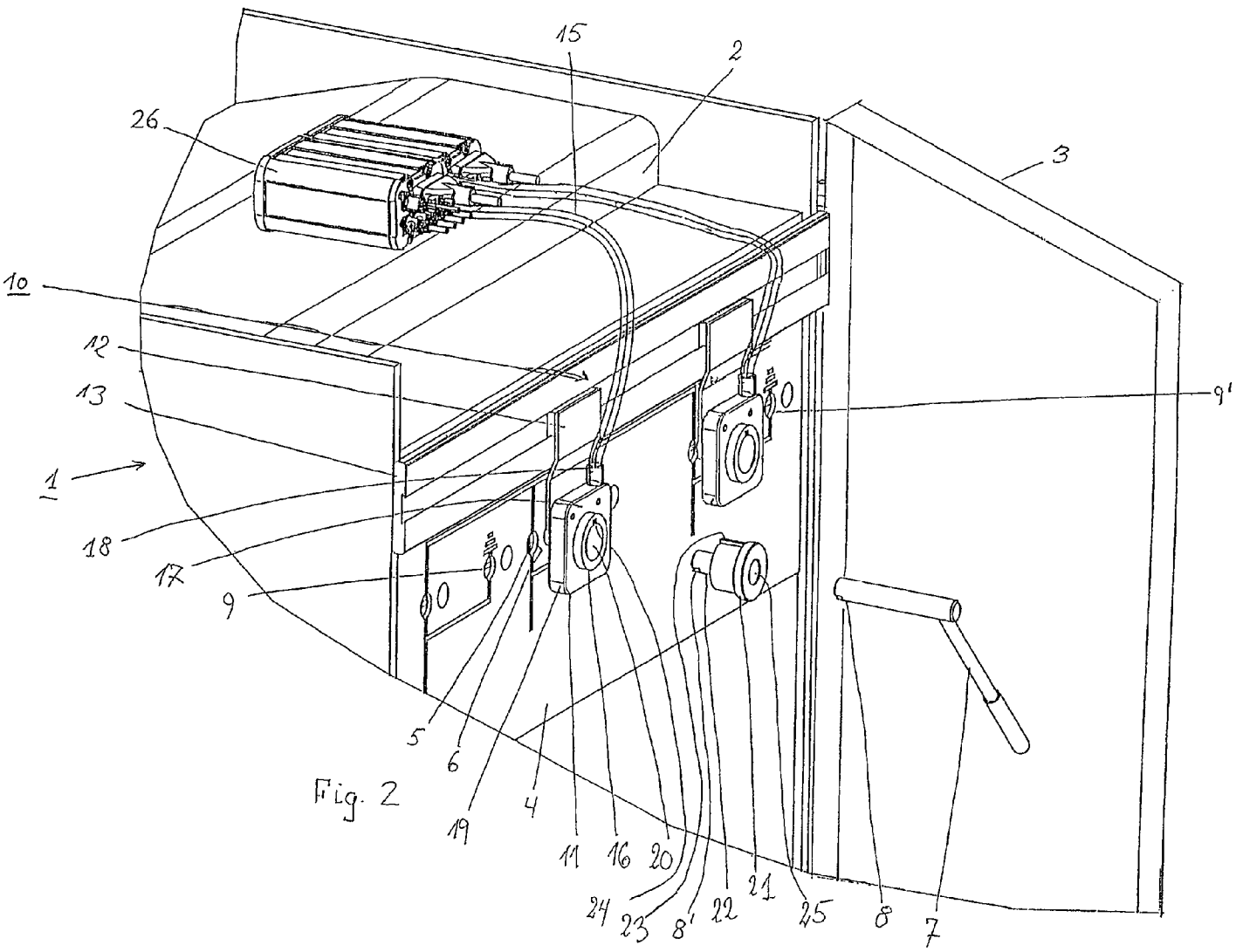
FIG. 2 shows a further embodiment of a motor operator for operating two switches of a switchgear, FIG. 3 showing an overview of the arrangement of the control box.

In a further embodiment, as shown in FIG. 2, the switchgear is equipped with a motor operator comprising two worm gear housings and a control box 26 containing two individual motors for the worm gears and the electronic control system for the control of the motor operator. The control box 26 is located in the compartment over the switchgear, a distance from the operating shafts of the switchgear.

Figure 3:
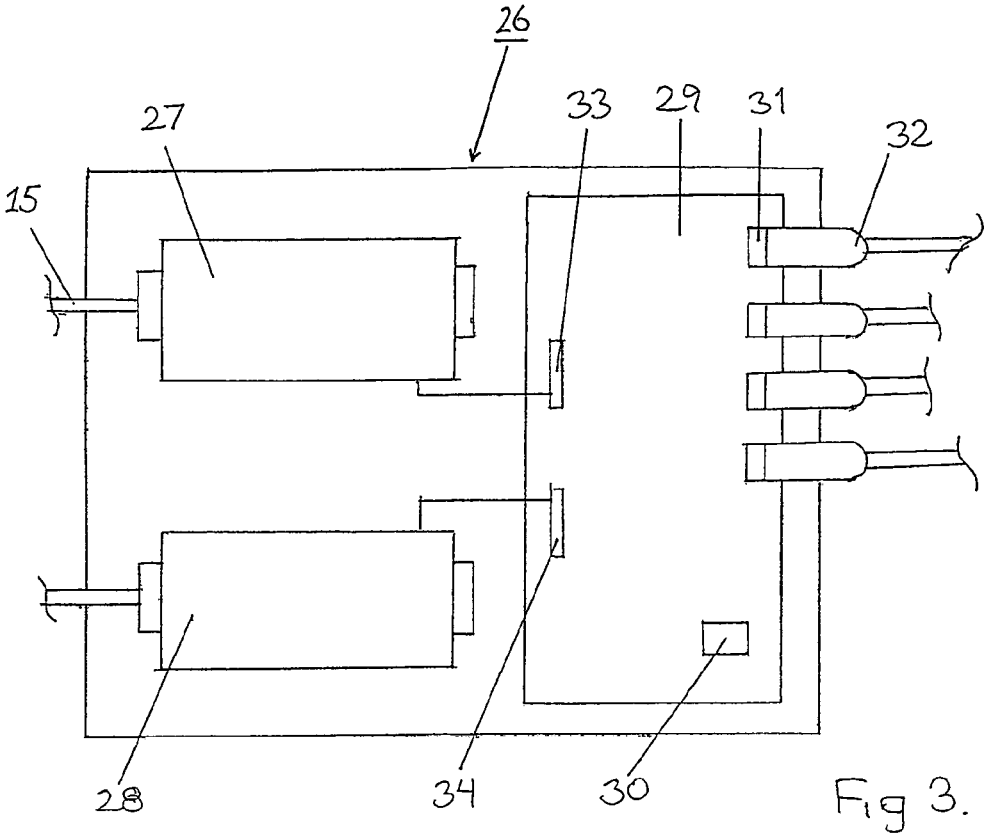

As can be seen from FIG. 3, showing an overview of the arrangement of the control box 26, the control box contains the control system and the motors 27, 28 for operating the switchgear. The control system includes a printed circuit board 29 with the power electronics to drive the motors 27, 28, and a controller 30, preferably in the form of a microcontroller, which also features the interfacing with the overall control system of the switchgear. Equipped on the printed circuit board 29 are connectors 31 for attaching a supply of power to the system and for multipurpose inputs and outputs. The connectors 31 on the printed circuit board are placed adjacent to the wall of the cabinet of the control box 26 for easy plugging of power supply and interface cables 32 directly into the sockets through holes made from outside of the cabinet. One of the inputs is for receiving a potentiometer for determining the angle rotation of the operating shaft of the switchgear, which could be substituted by a magnetically based arrangement using a Hall-sensor. Another input in the form of a logical input to indicate if the adapter is plugged correctly into the worm wheel or not, is available. An input/output is also used for a multidirectional data bus for interfacing data with a remote control. For connecting the motors 27, 28, the printed circuit board is equipped with connectors 33, 34, and allows easy and reliable electrical connection of the motors which are also placed internally in the cabinet. On the axles of the motors 27, 28, are flexible axles 10 mounted to the driven end 18 on the worm.

Figure 4:
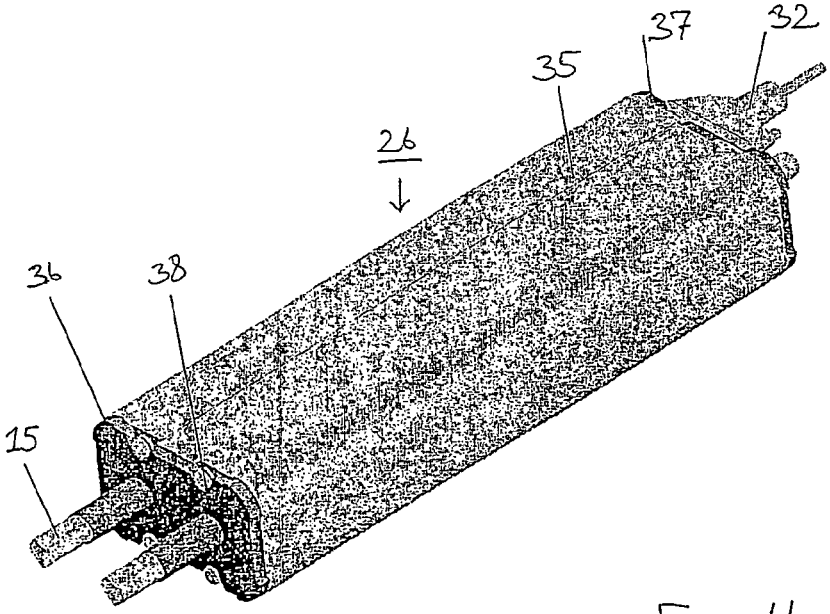
FIG. 4 shows a further embodiment of the control box which includes both the control and the motor drives.

FIG. 4 shows a further embodiment of the control box which includes both the control and the motors 27. The housing of the control box consists of an elongated extruded aluminum tube 35, with a front and rear cover 36, 37, which is secured by means of screws 38, in each end of the tube. In the tube 35 is internally on both sidewalls formed a slot for fixing and positioning a printed circuit board 29 for the control system in its position in the control box 26. Similarly the slot can be used for fixing a mounting frame for mounting the motor drives 27, 28 in the control box. In a first end of the control box housing the motor axles are protruding and flexible axles 15 are mounted to those motor axles. In the distant second end of the housing the power- and interface cables 32 are connected. In a preferred embodiment the connectors are plugged directly into connection sockets on the printed circuit board, through ports made in the enclosure 35, preferably in the rear cover 37. It will be appreciated that the ports are equipped with means for protecting the control box 26 against intruding water or dust, in order to maintain a reliable functioning of the motor drive.

Figure 5:
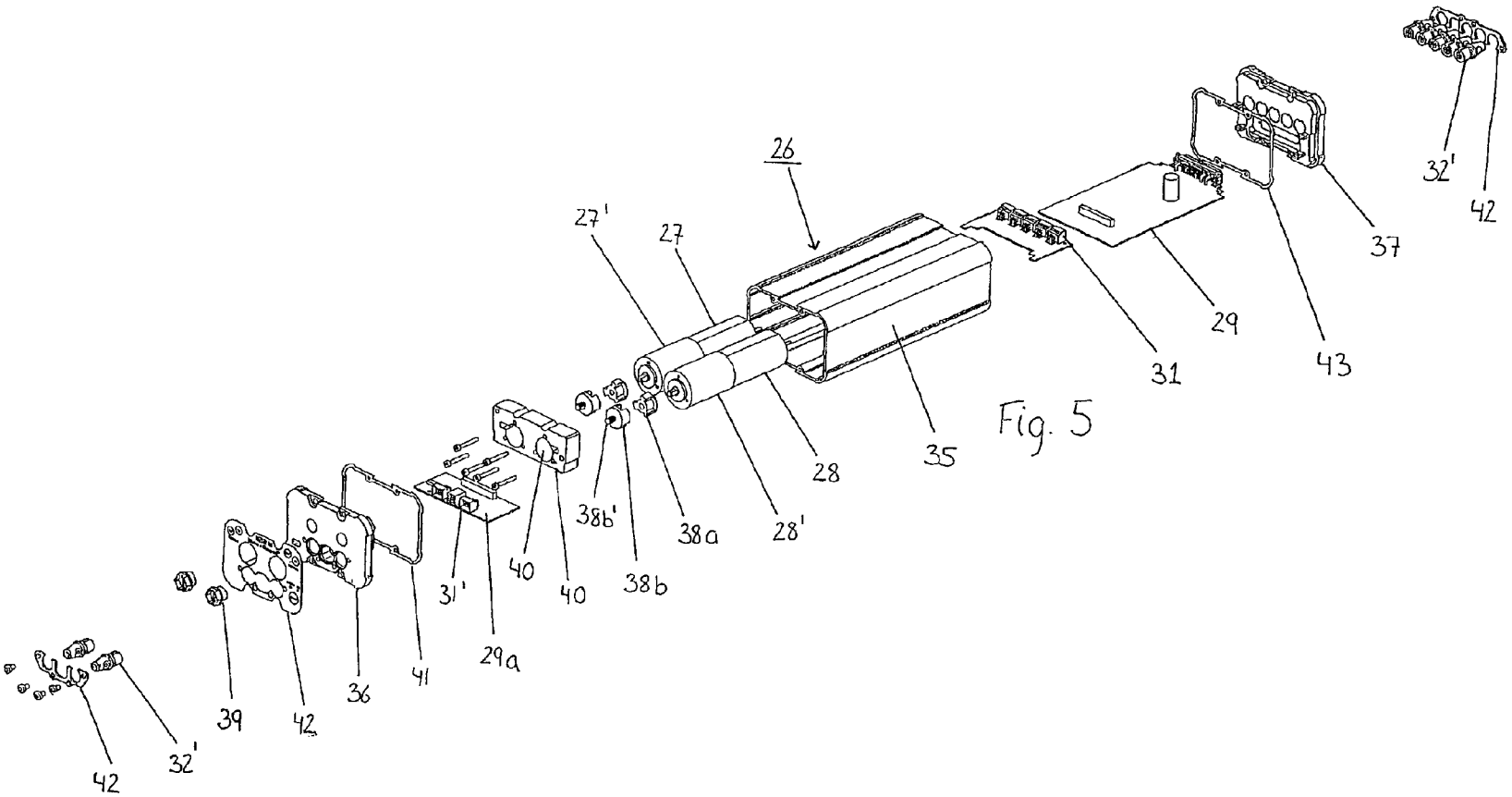
FIG. 5 shows an exploded view of a control box.
Figure 7:
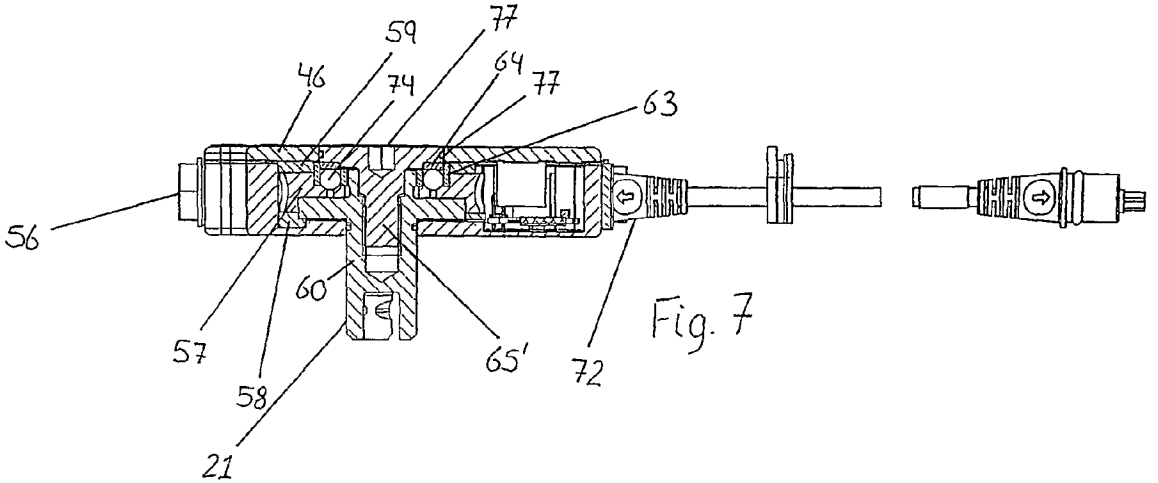
FIG. 7 shows a longitudinal section along line A-A in FIG. 6.
Figure 6:
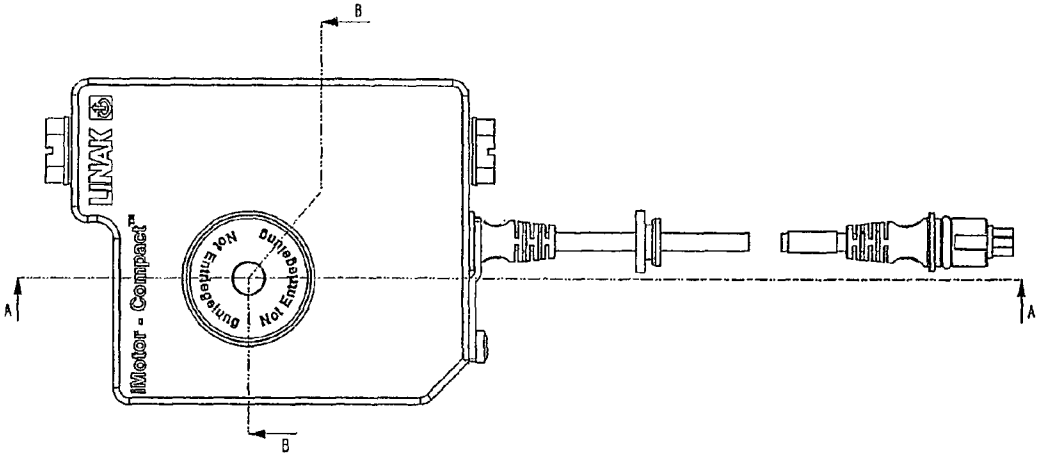
FIG. 6 shows an embodiment of the motor operator seen from the front surface.
Figure 8:
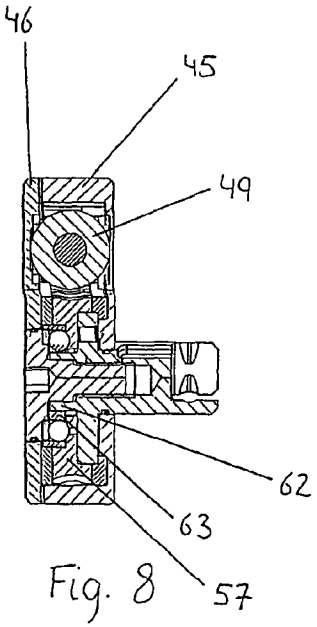
FIG. 8 shows a cross section along line B-B in FIG. 6.
Figure 9:
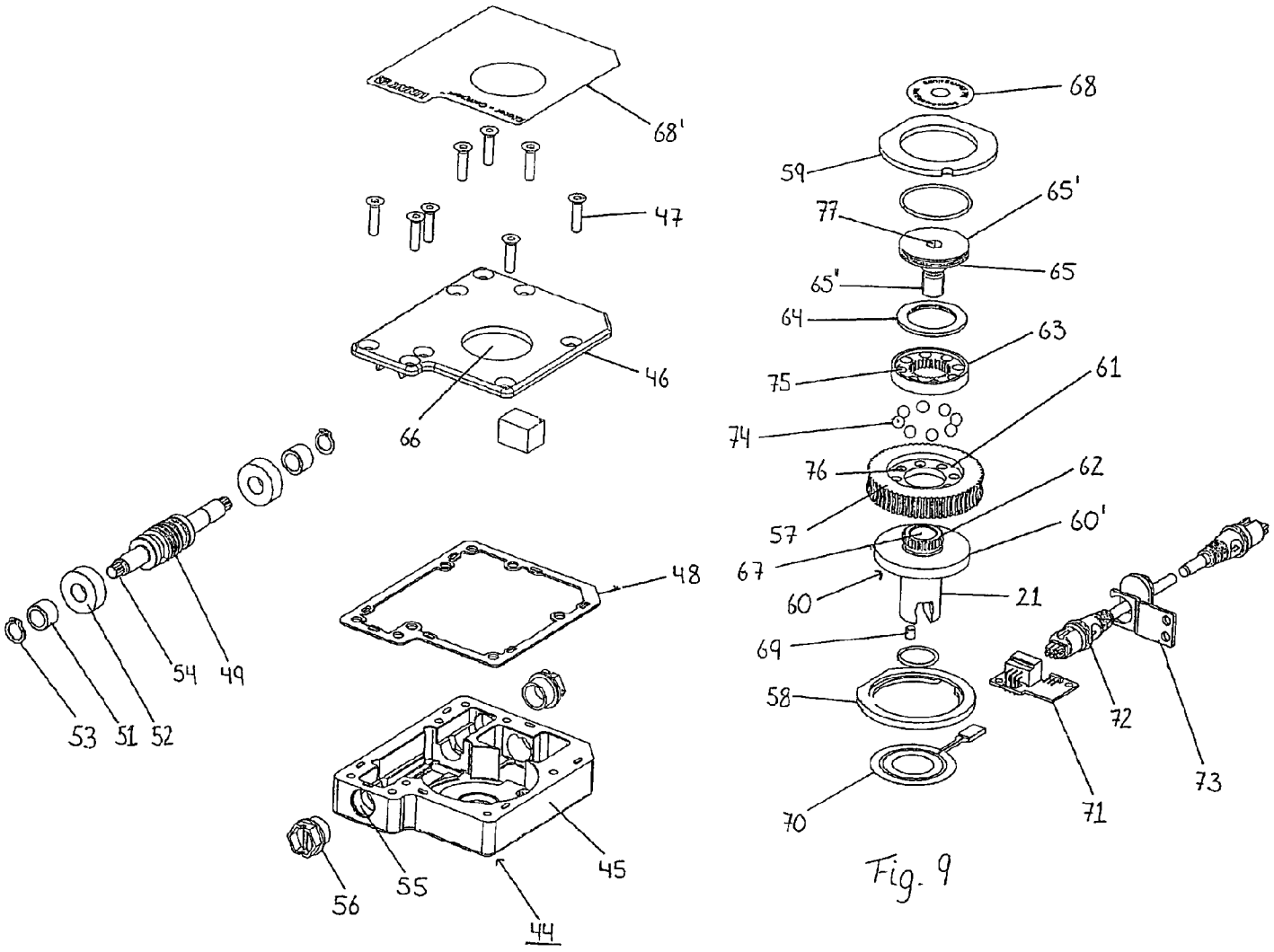
FIG. 9 shows an exploded view of the motor operator in FIGS. 6-8.

In FIG. 5 is an exploded view of a control box 26 similar to that shown in FIGS. 3-4 and the same reference numerals are used for the same components. The motors 27,28 are having a front gear 27',28' in the nature of a planet gear or gears. On the output shaft 28' there is a first part of a claw coupling 38*a* in engagement with a second part of the claw coupling 38*b*. The second part of the claw coupling is having an output shaft 38*b'* in the nature of a spline for a connector 39 for connection of the end of the flexible shaft 15. The motors 27,28 is attached to a front element 40 by means of screws and the claw coupling 38*a*,38*b* is resting in an aperture 40',40'. The outer surface of the front element 40 is in a snug fitting manner mating the upper part of the internal cross section of the tubular housing 35. The front element 40 is attached to the front cover 36 by means of screws and the front element 40 is again fixedly secured to the tubular housing by means of screws. Reference numeral 41 is a gasket located between the end of the tubular housing 35 and the front cover 36. The front cover 40 is supplied with a printed sheet 42 on which is printed various user information. The connectors 39 for the flexible shafts 15 are resting in an aperture in the front cover 36. At the front end of the housing 35 there is a further circuit board 29*a* furnished with connectors 31 for receiving cables. The sockets 32' of the cables is retained by a locking beam 42 attached by screws to the front cover. The same is true for the interfaces cables 32 at the rear end of the control box 26. At the rear end reference numeral 43 also designates a gasket between the rear cover 37 and the tube of the housing 35.

In FIGS. 6-9 is shown a further embodiment of the motor operator or more specifically the operator unit with a worm gear housing 44 comprising a compartment 45 of die cast metal and a front cover 46 attached to the compartment 45 by means of screws 47 and with an gasket 48 for water and dust proofing purposes. In the compartment 45 there is embedded a worm 49 having at both end a needle and axial bearing 51,52 kept in position by means of a locking spring 53. The ends of the shaft of the worm 49 are designed with a spline connection 54 for receiving an end of the flexible shaft 15. The ends of the worm 49 are available through an aperture 55 in the sidewall of the compartment 45. The apertures 55 can be closed by means of a plug 56. Accordingly one may freely choose to connect the flexible shaft 15 at either end of the worm 49. The worm 49 is in mesh with a worm wheel 57 also situated in the compartment 45 and located between two sliding ring elements 58,59 of a plastic material. An adapter 60 is with a circular plate element 60' received in a recess 61 in the worm wheel 57. The adapter 60 is having a connection shaft 22 similar to the connection shaft of the embodiment shown in FIG. 1 and is therefore given the same reference numeral. At the opposite end of the connection shaft 22 the adapter 60 is having a circular portion with an external tooting 62 in mesh with an internal tooting of a ring 63 also located in the recess 61 of the worm wheel 57. On top of the ring 63 there is a washer 64. The washer 64 is kept in place by means of a retaining element 65 having a circular plate shaped portion 65' and a stem 65" with external threads which could be screwed into a hole 67 with internal threads in the central portion 62 of the adapter 60. The retaining element 65 is dust and water proof by means of an O-ring 67 located in a groove in the side wall of the plate shaped portion 65' of the retaining element. On top of the retaining element 65 there is a printed sheet 68 bearing user information likewise the front cover 46 is furnished with a printed sheet 68 also bearing user information. In a hole in the circular plate member 60' there is located a spring loaded ball 69 running on a potentiometer 70 connected to an electronic print 71. The potentiometer 70 can by means of a cable 71 be connected to the control box. The plug of the cable could be secured against unintentional unplugging by means of a locking plate 73 attached by screws to the compartment 45. The potentiometer 70 is determining the angle position of the connection shaft as previously described. The connection shaft 21 is via the threads on the central portion 62 of the adapter 60 meshing with the internal threads of the ring 63 in engagement with the worm wheel 57 by means of a number of balls 74 resting in through holes 75 in the ring 63 and apertures 76 in the recess 61 of the worm wheel 57. The balls 74 are kept in their position by means of the washer 64 and the retaining element 65. The switches of a switch gear are as previously mentioned spring loaded for instantaneous switching of the switches. In case something goes wrong and the switch for some reason or another is caught in an intermediate position then the operating shaft of the switch is under a heavy spring load which is conveyed to the worm gear which is self-locking. To dismount the operator unit, i.e. the worm gear housing 44 it is therefore necessary to release the worm gear, which is done by unscrewing the retainer element 65 by means of an Allen key inserted into the hexagonal hole 77. When the retainer element 65 is screwed outwards then space is admitted to the balls 74 to move out of engagement with the worm wheel 57 and the operator unit could then dismounted. Before remounting the operator unit then the position of the connection shaft 21 should be reset. It would be obvious that also this embodiment could easily by adapted to switchgears with various coupling parts of the operating shaft of a switchgear simply by replacing the adapter 21 with a mating coupling part. Moreover, this embodiment could also be used for switchgear where the operating unit, i.e. the worm gear housing 45 is mounted in a distance from the coupling part of the operating shaft simply by employing an intermediate shaft furnished with respective coupling part in each end.

Although the motor operator has been described in connection with a switchgear having a front door, it would be understood that it could also be used in connection with switchgear where the front surface is exposed to the open air.

The invention claimed is:

1. A motor operator for switchgear for mains power distribution system, the switchgear comprising:

a cabinet with at least one operating shaft for at least one mains switch located inside the cabinet, said operating shaft having a coupling part accessible on a front surface of the cabinet and said operating shaft being rotatable between at least two positions namely corresponding to a closed and an open position of the mains switch, the motor operator comprising:

a housing having a front surface and rear surface and a side surface connecting the front and rear surfaces, a rotatable connection shaft with a first and second end said first end being designed for engagement with the coupling part of the operating shaft of the switchgear, said connection shaft rests in a hole in the front surface of the housing, an electric motor, wherein the front surface of the housing includes an opening for the connection shaft, a worm gear with a worm and a worm wheel, said worm being in driving connection with the motor for rotating the connection shaft, wherein the worm wheel and the worm are embedded in a separate worm gear housing and a drive end of the worm is accessible from outside of the housing for connection with the motor, and an adapter is fixedly connected to the second end of the connection shaft, and there is a recess in the worm wheel for rotational interlocking connection of the adapter with the worm wheel.

2. The motor operator according to claim 1, wherein the connection between the drive shaft of the motor and a driven end of the worm comprises a flexible shaft.

3. The motor operator according to claim 1, wherein the rotational interlocking connection between the adapter and the worm wheel comprises a releasable coupling.

4. The motor operator according to claim 1, wherein the recess in the worm wheel is a through hole designed for or has means for receiving the adapter in a rotational interlocking manner and there is an opening in the front surface of the housing for exposing the recess in the worm wheel for receiving the adapter.

5. The motor operator according to claim 4, wherein the means for rotational interlocking of the adapter in the worm wheel-comprises at least one key and one keyway and the key could be pushed forward from an retracted position to an expelled position in engagement with the keyway by means of a wrench for manually operation of the switchgear.

6. The motor operator according to claim 1, including a sensor to determine if the adapter is received in the recess or through a hole of the worm wheel in a rotational interlocking manner.

7. The motor operator according to claim 1, including a sensor to determine the angle of rotation of the worm wheel.

8. The motor operator according to claim 1, including a sensor to determine if a lock for at least one earthing contact of the switchgear is in a locked or an unlocked position.

9. The motor operator according to claim 1, including a sensor to determine whether the earthing contact is in an open or a closed position.

10. A method for carrying out a learning cycle to match a measurement of rotation angle of a worm wheel with a state of switchgear, including a first set point corresponding to the closed state of the switchgear and including a second set point corresponding to the open state of the switchgear, where the first set point is the measurement of the rotation angle of the worm wheel stored just when the transition from the open to closed state of the mains switch is performed, and where the second set point is the measurement of the rotation angle of the worm wheel stored just when the transition from the closed to open state of the mains switch is performed, three scales for rotation angle measurement being angles over the first set point, angles under the second set point and angles inbetween the set points reflect a closed and an open state of the mains switch and a scale between the first and second set points.

11. A method for carrying out a learning cycle to match a measurement of rotation angle of a worm wheel with a closed and open state of a mains switch where a rotational spring force on an operating shaft is relaxed, the first set point being the rotation angle measurement where the mains switch is in the closed position and the spring is relaxed and the connection shaft of an adapter is free to be removed or inserted fitting its rotational interlocking means in the worm wheel, and the second set point being the rotation angle measurement where the mains switch is in the open position and the spring is relaxed and the adapter with the connection shaft is free to be removed or inserted fitting its rotational interlocking means in the worm wheel.

12. A method for adapting the rotation angle of the worm wheel to correspond to the actual state of the mains switch, where the motor operator is forced to rotate the worm wheel to match the stored angles corresponding to the first and second set point of method according to claim 10.

* * * * *